United States Patent [19]

De Keyzer

[11] Patent Number: 4,859,566

[45] Date of Patent: Aug. 22, 1989

[54] IMAGE-RECEIVING MATERIAL

[75] Inventor: René M. De Keyzer, St. Niklaas, Belgium

[73] Assignee: Agfa-Gevaert, N.V., Mortsel, Belgium

[21] Appl. No.: 228,180

[22] Filed: Aug. 4, 1988

[30] Foreign Application Priority Data

Sep. 8, 1987 [EP] European Pat. Off. ..... 87201700.9

[51] Int. Cl.[4] ..... G03C 5/54

[52] U.S. Cl. ..... 430/232; 430/227; 430/231

[58] Field of Search ..... 430/227, 231, 232, 204

[56] References Cited

U.S. PATENT DOCUMENTS 4,304,835 12/1981 Bloom et al. ..... 430/232
4,605,609 8/1986 Okazaki et al. ..... 430/232
4,734,354 3/1988 Takagi ..... 430/232

*Primary Examiner*—Richard L. Schilling
*Attorney, Agent, or Firm*—A. W. Breiner

[57] ABSTRACT

Image receiving material suited for use in the silver complex diffusion transfer reversal process which material contains a water-impermeable support coated with (1) an image-receiving layer containing physical development nuclei dispersed in a waterpermeable binder and (2) a waterpermeable top layer free from development nuclei and containing a hydrophilic colloid, characterized in that:

(i) the total solids coverage of said two layers (1) and (2) is at most 2 g/m2, (ii) in layer (1) the coverage of said nuclei is in the range of 0.1 mg/m2 to 10 mg/m2, and the coverage of binder is in the range of 0.4 to 1.3 g/m2, and (iii) in said top layer (2) the coverage of hydrophilic colloid is in the range of 0.1 to 0.9 g/m2.

10 Claims, No Drawings

IMAGE-RECEIVING MATERIAL

DESCRIPTION

The present invention relates to an image-receiving material suitable for use in the silver complex diffusion transfer reversal process.

The principles of the silver complex diffusion transfer reversal process, hereinafter called DTR-process, have been described e.g. in U.S. Pat. No. 2,352,014 and in the book "Photographic Silver Halide Diffusion Processes" by André Rott and Edith Weyde—The Focal Press—London and New York, (1972).

The DTR-process initially only intended for office copying purposes has found now wide application in the graphic art field, more particularly in the production of screened prints from continuous tone originals. In said production continuous tone information is transformed into halftone information using graphic art screen exposure techniques. Essential in screening is the transformation of continuous tone values into black dots of different size and different % dot covering, also called % dot value.

In order to meet the high quality demands of screened copies with regard to screen dot definition and tonal reproduction measures have to be taken in the image-receiving material, hereinafter also called positive material, to obtain utmost image acutance and neutral black image density.

From many experiments which have been carried out the following factors influence the image tone: (ref. the already mentioned book of A. Rott and E. Weyde, p. 58):

1. The properties, the number and the concentration of the development nuclei in the positive material,
2. The time for which the positive material and light-sensitive material remain in contact,
3. The nature of the binding agent in the image-receiving layer,
4. The quantity of complexing agent present, and
5. The presence of additives which influence the image-tone.

Most of the DTR-positive materials now available on the market are composed of two or even three layers. Such materials normally contain on top of the nuclei containing layer a layer which itself contains no nuclei and otherwise has the same composition as the nuclei containing layer and mainly serves to ensure good contact between the negative and positive material during transfer. Moreover, after drying this layer provides a protective coating for the image receiving layer containing the silver image. It further prevents bronzing or plumming of the black image areas in preventing the protruding of silver from the image receiving layer in the form of a glossy silver mirror (ref. the above mentioned book p. 50).

The transfer behaviour of the complexed silver largely depends on the thickness of the image-receiving layer and the kind of binding agent or mixture of binding agents used in the nuclei containing layer. In order to obtain a sharp image with high spectral density the reduction of the silver salts diffusing into the image receiving layer must take place rapidly before lateral diffusion becomes substantial.

It is an object of the present invention to provide an image receiving material suitable for forming sharp non-bronzing silver images within very short processing and drying times and operatable with small amounts of absorbed processing liquid for forming images with particularly low yellowing.

Other objects and advantages of the present invention will appear from the further description and examples.

In accordance with the present invention an image-receiving material suited for use in the silver complex diffusion transfer reversal process is provided which material contains a water-impermeable support coated with (1) an image-receiving layer containing physical development nuclei dispersed in a waterpermeable binder and (2) a waterpermeable top layer free from development nuclei and containing a hydrophilic colloid. characterized in that :

(i) the total solids coverage of said two layers (1) and (2) is at most 2 g/m2, (ii) in layer (1) the coverage of said nuclei is in the range of 0.1 mg/m2 to 10 mg/m2, and the coverage of binder is in the range of 0.4 to 1.3 g/m2, and (iii) in said top layer (2) the coverage of hydrophil colloid is in the range of 0.1 to 0.9 g/m2.

The coating of said layers proceeds preferably with slide hopper coater or curtain coater known to those skilled in the art.

Suitable physical development nuclei for use in the-image receiving layer which promote the reduction of the diffusing silver complexes into metallic silver are described on pages 54–57 of the already mentioned book of A. Rott and E. Weyde. Preferred nuclei are e.g. colloidal silver and heavy metal sulphide nuclei such as palladium sulphide, nickel sulphide and silver-nickel sulphide nuclei.

The support for the image receiving layer may be any opaque or transparent support that at the side of the image receiving layer is water-impermeable, e.g. hydrophobic resin support or resin coated paper support.

Transparent supports are made e.g. of cellulose triacetate. polyvinyl chloride, polycarbonates, polystyrene or polyesters such as polyethylene terephthalate being provide with a suitable subbing layer(s) for adhering thereto a hydrophilic colloid layer.

Opaque paper supports are usually made of paper coated with a water-impermeable layer of a polyolefine such as polyethylene.

A white appearance of the image background even when a yellow stain should appear on storage is obtained by incorporation of optical brightening agents in the support, image-receiving layer and/or interlayer between the support and the image-receiving layer.

According to a particular embodiment the nuclei containing layer (1) is present on a nuclei-free underlying hydrophilic colloid undercoat layer or undercoat layer system having a coverage in the range of 0.1 to 1 g/m2 of hydrophilic colloid, the total solids coverage of layers (1) and (2) together with the undercoat being at most 2 g/m2.

The undercoat optionally incorporates substances that improve the image quality, e.g. incorporates a substance improving the image-tone or the whiteness of the image background. For example, the undercoat may contain a fluorescent substance, silver complexing agent(s) and/or development inhibitor releasing compounds known for improving image sharpness.

According to a special embodiment the image-receiving layer is applied on an undercoat playing the role of a timing layer in association with an acidic layer serving for the neutralization of alkali of the image-receiving layer. By the timing layer the time before neutralization occurs is established, at least in part, by the time it takes for the alkaline processing composition to penetrate through the timing layer. Materials suitable for neutralizing layers and timing layers are disclosed in Research Disclosure July 1974, item 12331 and July 1975, item 13525.

In the image-receiving layer (1) and/or in said top layer (2) and/or in an undercoat gelatin is used preferably as hydrophilic colloid. In layer (1) gelatin is present preferably for at least 60% by weight and is optionally used in conjunction with an other hydrophilic colloid, e.g. polyvinyl alcohol, cellulose derivatives, preferably carboxymethyl cellulose, dextran, gallactomannans, alginic acid derivatives, e.g. alginic acid sodium salt and/or watersoluble polyacrylamides. Said other hydrophilic colloid may be used also in the top layer for at most 10% by weight and in the undercoat in an amount lower than the gelatin content.

The image-receiving layer and/or a hydrophilic colloid layer in water-permeable relationship therewith may comprise a silver halide developing agent and/or silver halide solvent, e.g. sodium thiosulphate in an amount of approximately 0.1 g to approximately 4 g per $m^2$.

The image-receiving layer or a hydrophilic colloid layer in water-permeable relationship therewith may comprise colloidal silica.

In at least one of the layers of the present image-receiving material substances can be contained, which play a role in the determination of the colour tone of the diffusion transfer silver image. Substances providing a neutral colour tone are called black-toning agents, e.g. as described in GB A No. 561,875 and BE A No. 502,525.

The image-receiving layer may contain as physical development accelerators, in operative contact with the developing nuclei, thioether compounds such as those described e.g. in DE A No. 1,124,354; U.S. Pat. Nos. 4,013,471; 4,072,526; and in EU A No. 0,026,520.

When applying an optical brightening agent in the present image-receiving material preference is given to an optical brightening agent that is inherently by its structure resistant to diffusion or is made resistant to diffusion by use in conjunction with another substance wherein it is dissolved or whereto it is adsorbed.

For example, to make an optical brightening agent resistant to diffusion one of the following techniques may be applied.

According to a first technique known from colour photography the optical brightening compound is substituted with a long chain aliphatic residue and ionomeric residue as is known in the synthesis of diffusion resistant colour couplers.

According to a second technique an optical brightening agent of the oleophilic type is incorporated in droplets of a water-immiscible solvent so-called "oilformer", e.g. dibutylphthalate.

According to a third technique the optical brightening agent is used in conjunction with a polymeric hydrophilic colloid adsorber, a so-called trapping agent, e.g. poly-N-vinylpyrrolidinone as described in e.g. in U.S. Pat. Nos. 3,650,752, 3,666,470 and 3,860,427 and published European patent application No. 0 106 690.

According to a fourth technique latex compositions are used wherein latex particles are loaded, i.e. contain in dissolved and/or adsorbed state an optical brightening as described e.g. in German Offenlegungsschrift (DE-OS) No. 1,597,467 and in U.S. Pat. No. 4,388,403.

A preferred optical brightening agent, calling fluorescent agent A, for use in an image-receiving material according to the present invention corresponds to the following structural formula:

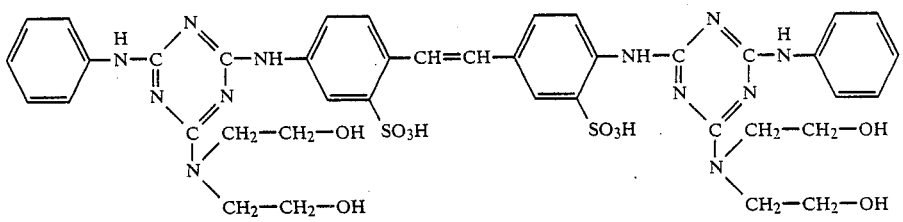

The image-receiving layer and/or other hydrophilic colloid layer of the present image-receiving material may have been hardened to achieve enhanced mechanical strength. Appropriate hardening agents for hardening the natural and/or synthetic hydrophilic colloid binding agents in the image-receiving layer include e.g. formaldehyde, glyoxal, mucochloric acid, and chrome alum. Hardening can also be effected by incorporating a hardener precursor in the image-receiving layer, the hardening of the hydrophilic colloid therein being triggered by the treatment with the alkaline processing liquid. Other suitable hardening agents for hardening the hydrophilic colloid binding agents in the image-receiving layer are vinylsulphonyl hardeners, e.g. as described in Research Disclosure 22,507 of January 1983.

The image-receiving material according to the present invention can be used in the form of roll film or sheet film or in the form of a filmpack e.g., for in-camera-processing.

The present image-receiving material can be used in conjunction with any type of photographic silver halide emulsion material suited for use in diffusion transfer reversal processing, preference being given to silver halide emulsion layers the silver halide of which is mainly silver chloride because of its relatively easy complexing with thiosulphate ions. The silver halide grains can have any size or shape and may be prepared by any technique known in the art, e.g. by single-jet or double jet precipitation. Negative type or direct-positive type silver halide grains may be used. Negative and positive working type silver halide emulsions are known in the art and are described e.g. in Research Disclosure, November 1976, item 15162.

The binder of the photographic silver halide emulsion layer in the photographic material is preferably gelatin. But instead of or together with gelatin, one or more other natural and/or synthetic hydrophilic colloids e.g. albumin, casein, zein, polyvinyl alcohol, alginic acids or salts thereof, cellulose derivatives such as carboxymethyl cellulose, modified gelatin, etc. can be used. The weight ratio of hydrophilic colloid to silver halide expressed as equivalent amount of silver nitrate in the silver halide emulsion layer(s) of the photosensitive element usually is between 1:1 and 10:1.

In addition to the binder and the silver halide, the photosensitive element may contain in the photographic silver halide emulsion layer and/or in one or more layers in water-permeable relationship therewith any of the kinds of compounds customarily used in such layers for carrying out the DTR-process. Such layers may comprise e.g. one or more developing agents, coating aids, stabilizing agents or fog-inhibiting agents e.g. as described in GB A No. 1,007,020 and in the above-mentioned Research Disclosure N° 24236 , plasticizers, development-influencing agents e.g. polyoxyalkylene compounds, onium compounds, and thioether compounds as described e.g. in U.S. Pat. Nos. 2,938,792; 3,021,215; 3,038,805; 3,046,134; 4,013,471; 4,072,523; 4,072,523; 4,072,526; 4,292,400; and in DE A No. 1,124,354, spectral sensitizing agents, hardeners e.g. vinylsulphonyl hardeners such as those described e.g. in DE A No. 2,749,260; DE A No. 1,808,685; DE A No. 2,348,194 and in Research Disclosure 22,507 of January 1983.

In case developing agents are to be incorporated into the silver halide emulsion, they are added to the emulsion composition preferably after the chemical ripening stage following the washing of the emulsion.

The silver complex diffusion transfer reversal processing is by nature a wet processing including development of the exposed silver halide in the emulsion layer of the photosensitive element, the complexing of residual undeveloped silver halide and the diffusion transfer of the silver complexes into the image-receiving material wherein physical development takes place.

The processing proceeds in alkaline aqueous medium.

The developing agent or a mixture of developing agents can be incorporated into an alkaline processing solution and/or into the photosensitive element comprising a photographic silver halide emulsion layer. When incorporated into the photosensitive element, the developing agent(s) can be present in the silver halide emulsion layer or are preferably present in a hydrophilic colloid layer in water-permeable relationship therewith, e.g. in the anti-halation layer adjacent to the silver halide emulsion layer of the photosensitive element. In case the developing agent or a mixture of developing agents is contained in the photosensitive element, the processing solution is merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol.

The silver halide solvent, preferably sodium thiosulphate, may be supplied from the non-light-sensitive image-receiving element as mentioned above, but it is normally at least partly already present in the alkaline processing solution. When present in the alkaline processing solution, the amount of silver halide solvent is in the range of e.g. 10 g/l to 50 g/l.

The alkaline processing solution usually contains alkaline substances such as tribasic phosphate, preserving agents e.g. sodium sulphite. thickening agents e.g. hydroxyethylcellulose and carboxymethylcellulose, fog-inhibiting agents such as potassium bromide, silver halide solvents e.g. sodium or ammonium thiosulphate, black-toning agents especially heterocyclic mercapto compounds. The pH of the processing solution is preferably in the range of 10 to 14.

With respect to alkaline substances for use in the alkaline processing solution, combinations of sodium carbonate with sodium hydroxide and/or 2-methylamino-ethanol were found to be advantageous because of improved buffering action and retarded exhaustion of the processing solution.

A processing solution wherein the alkalinity is due solely to amines, e.g. alkanolamines, having a pKa value equal to or less than 9 is less prone to $CO_2$-absorption. The use of amines and alkanolamines in processing solutions for the silver complex diffusion transfer reversal process are described e.g. in U.S. Pat. Nos. 2,702,244 and 4,568,634, GB No. 2 159 968 and DE-OS (Offenlegungsschrift) No. 3 533 449. Amines having a pKa value higher than 8.5 and their use in the DTR-process are described in Research Disclosure, July 1987 item 27939. Processing solutions wherein the alkalinity is derived from amines with pKa value higher than 9 are preferred for a rapid processing. The concentration of said amines in the processing solution is preferably in the range of 0.1 to 5 mole per liter.

For particulars about exposure and developing apparatus, which may be applied in the DTR-process according to the present invention reference is made e.g. to the above-mentioned book by A. Rott and E. Weyde and to patent literature cited therein.

The image receiving elements according to the present invention are particularly suited for the reproduction of line and screen images. They can be used likewise for the production of identification documents according to the DTR-process. Such identification documents contain a photograph and/or identification data formed by diffusion transfer in an image-receiving layer on a water-impermeable resin support, e.g. polyvinyl chloride resin support or polyethylene-covered paper support, which to exclude any forgery by alteration of the identification data and/or photograph, is laminated to a transparent protective cover sheet. The transparent protective cover sheet usually is a thermoplastic resin sheet such as a polyester film sheet, e.g. a polyethylene terephtalate film sheet, which is coated with polyethylene at the side that is to be laminated against the image-receiving-layer carrying the identification data.

The following examples some of which are presented for comparative reason and relate to materials not within the scope of the present invention are given for illustrating the improvements obtained with image-receiving materials according to the present invention. The ratios and percentages mentioned therein are by weight unless otherwise stated.

EXAMPLE 1

(comparative example not within the scope of the present invention)

Composition of the image-receiving material

To a polyethylene-coated paper support having a weigth of 100 g per m2 an aqueous coating composition was applied to obtain a water-permeable layer having in dry state the following ingredient coverage per m2 :

| | |
|---|---|
| gelatin | 2.4 g |
| carboxymethyl cellulose | 0.66 g |
| colloidal Ag—Ni sulphide | 3.55 mg |
| said sulphide acting as developing nuclei was applied from a 10% aqueous gelatin solution resulting in a | |

-continued

| | |
|---|---|
| gelatin coverage of | 0.07 g |
| 20% aqueous formaldehyde | 8.5 ml |
| 5% aqueous solution of wetting agent isooctyl-p-phenylene-O($CH_2CH_2O$)$_8CH_2COONa$ | 12 ml |

Composition of the photosensitive material

A gelatin silver chloride emulsion (gelatin/silver nitrate=1.67), hardened in the usual way with formaldehyde, was coated at 45° C. on a polyethylene-covered paper support of 140 g per m2 in such a way that an amount of silver chloride equivalent to 1.7 g of silver nitrate was present per m2.

The dry emulsion layer was coated on an undercoat obtained from the following coating composition at a wet coverage of 1 l per 20 m2 being coated at a temperature of 45° C.:

| | |
|---|---|
| demineralized water | 800 ml |
| gelatin | 75 g |
| ethanol | 200 ml |
| 1-phenyl-3-pyrazolidinone | 5 g |
| hydroquinone | 10 g |
| 20% aqueous formaldehyde | 10 ml |
| 5% aqueous carbon black dispersion | 20 ml |

Exposure and Processing

The resulting photosensitive element was image-wise exposed and the moistened, at the emulsion side only, with the following processing solution :

| | |
|---|---|
| demineralized water | 300 ml |
| trisodium phosphate.12 water | 75 g |
| sodium sulphite (anhydrous) | 40 g |
| potassium bromide | 0.5 g |
| sodium thiosulphate (anhydrous) | 20 g |
| monomethylamino ethanol | 15 ml |
| 1-phenyl-5-mercapto-tetrazole | 70 mg |
| demineralized water up to | 1000 ml |
| | pH: 12.4 |

After 3 to 5 s the moistened photosenstive element was brought in contact for 35 s (diffusion time) with the image-receiving material as described above.

Measurements

After separation of the contacting elements the maximum transmission density ($D_{TR}$) and the reflection density ($D_{RF}$) of the positive print were measured.

The "bronzing" of the image was visually assessed, and when present indicated with (+), when absent indicated with (−).

The drying time (till touch-dry) of the obtained print was determined at a 60% relative humidity and expressed in seconds.

The "yellowing" of the print was determined by measuring the minimum density (background density) behind a filter transmitting only blue light (400–500n nm) after keeping the print for 12 h without rinsing in an environment at 85% relative humidity.

The speed of image-formation was determined by notifying the time in seconds necessary to obtain a minimum reflection density of 1.50.

The results of the above measurements are expressed in the Table following the examples.

EXAMPLE 2

(Comparative example not within the scope of the present invention)

Composition of the image-receiving material

Onto a polyethylene-coated paper support having a weight of 100 g per m2 an aqueous coating composition was applied to obtain a water-permeable layer having in dry state the following ingredient coverage per m2:

| | |
|---|---|
| gelatin | 1.3 g |
| collodial Ag—Ni sulphide | 1 mg |

said sulphide acting as developing nuclei was applied from a 5% aqueous gelatin solution resulting in a gelatin coverage of 0.1 g To the dry resulting image-receiving layer a top layer was applied having in dry state the following ingredient coverage:

| | |
|---|---|
| gelatin | 0.7 g |

The hardening proceeded at a wet coverage of 1 l per 35 m2 with the following composition:

| | |
|---|---|
| demineralized water | 964 ml |
| gelatin | 20 g |
| 20% aqueous formaldehyde | 8.5 ml |
| 5% aqueous solution of wetting agent isooctyl-p-phenylene-O($CH_2CH_2O$)$_8CH_2COONa$ | 12 ml |

The thus prepared image-receiving material was processed as described in Example 1 in combination with the therein mentioned photosensitive material.

The obtained measurement results are mentioned in the Table following the Examples.

EXAMPLE 3

(According to the present invention)

Onto a polyethylene-coated paper support having a weigth of 100 g per m2 an aqueous coating composition was applied to obtain a water-permeable layer having in dry state the following ingredient coverage per m2:

| | |
|---|---|
| gelatin | 0.6 g |
| carboxymethyl cellulose | 0.1 g |
| colloidal Ag—Ni sulphide | 1 mg |
| said sulphide acting as developing nuclei was applied from a 5% aqueous gelatin solution resulting in a gelatin coverage of | 0.1 g |
| polyvinyl alcohol | 0.198 g |
| fluorescent agent A applied in a 3% by weight solution of the polyvinyl alcohol | 0.098 g |

To the dried image-receiving layer a top layer was applied having in dry state the following ingredient coverage:

| | |
|---|---|
| gelatin | 0.7 g |

The hardening proceeded at a wet coverage of 11 per 35 m2 with the following composition:

| | |
|---|---|
| demineralized water | 964 ml |

-continued

| | |
|---|---|
| 20% aqueous formaldehyde | 8.5 ml |
| 5% aqueous solution of wetting agent isooctyl-p-phenylene-O($CH_2CH_2O$)$_8CH_2COONa$ | 12 ml |

The thus prepared image-receiving material was processed as described in Example 1 in combination with the therein mentioned photosensitive material.

The obtained measurement results are mentioned in the Table following the Examples.

EXAMPLE 4

(According to the present invention)

Onto a polyethylene-coated paper support having a weigth of 100 g per m2 an aqueous coating composition was applied to obtain a water-permeable layer having in dry state the following ingredient coverage per m2:

| | |
|---|---|
| gelatin | 0.65 g |
| colloidal Ag—Ni sulphide | 1 mg |

said sulphide acting as developing nuclei was applied from a 5% aqueous gelatin solution resulting in a gelatin coverage of 0.1 g To the dry resulting image-receiving layer a top layer was applied having in dry state the following ingredient coverage:

| | |
|---|---|
| gelatin | 0.35 g |

The hardening proceeded at a wet coverage of 11 per 35 m2 with the following composition:

| | |
|---|---|
| demineralized water | 964 ml |
| 20% aqueous formaldehyde | 8.5 ml |
| 5% aquoous solution of wetting agent isooctyl-p-phenylene-O($CH_2CH_2O$)$_8CH_2COONa$ | 12 ml |

The thus prepared image-receiving material was processed as described in Example 1 in combination with the therein mentioned photosensitive material.

The obtained measurement results are mentioned in the Table following the Examples.

EXAMPLE 5

(According to the present invention)

Onto a subbed polyethylene terephthalate resin support having a thickness of 100 micron an aqueous coating composition was applied to obtain a water-permeable image-receiving layer having in dry state the following ingredient coverage per m2:

| | |
|---|---|
| gelatin | 1 g |
| colloidal Ag—Ni sulphide | 2 mg |
| said sulphide acting as developing nuclei was applied from a 5% aqueous gelatin solution resulting in a gelatin coverage of | 0.07 g |
| dextran (average molecular weight) | 0.15 g |
| sodium thiosulphate (anhydrous) | 0.055 g |

To the dried image-receiving layer a top layer was applied having in dry state the following ingredient coverage:

| | |
|---|---|
| gelatin | 0.40 g |

The hardening proceeded at a wet coverage of 1 1 per 35 m2 with the following composition:

| | |
|---|---|
| demineralized water | 964 ml |
| 20% aqueous formaldehyde | 8.5 ml |
| 5% aqueous solution of wetting agent isooctyl-p-phenylene-O($CH_2CH_2O$)$_8CH_2COONa$ | 12 ml |

The thus prepared image-receiving material was processed as described in Example 1 in combination with the therein mentioned photosensitive material.

The obtained measurement results are mentioned in the Table following the Examples.

EXAMPLE 6

(According to the present invention)

Onto a polyethylene-coated paper support having a weigth of 100 g per m2 an aqueous coating composition was applied to obtain a water-permeable undercoat having in dry state the following ingredient coverage per m2:

| | |
|---|---|
| gelatin | 0.6 g |
| polyvinyl alcohol | 0.198 g |
| fluorescent agent A applied in a 3% by weight solution of the polyvinyl alcohol | 0.098 g |

Onto said undercoat an image-receiving layer was applied having in dry state the following ingredient coverage:

| | |
|---|---|
| gelatin | 0.7 g |
| colloidal Ag—Ni sulphide | 1 mg |
| said sulphide acting as developing nuclei was applied from a 5% aqueous gelatin solution resulting in a gelatin coverage of | 0.1 g |
| carboxy methyl cellulose | 0.1 g |

To the dried image-receiving layer a top layer was applied having in dry state the following ingredient coverage:

| | |
|---|---|
| gelatin | 0.40 g |

The hardening proceeded at a wet coverage of 1 1 per 35 m2 with the following composition:

| | |
|---|---|
| demineralized water | 964 ml |
| 20% aqueous formaldehyde | 8.5 ml |
| 5% aqueous solution of wetting agent isooctyl-p-phenylene-O($CH_2CH_2O$)$_8CH_2COONa$ | 12 ml |

The thus prepared image-receiving material was processed as described in Example 1 with the therein mentioned photosensitive material.

The obtained measurement results are mentioned in the Table hereinafter.

TABLE

| Measured property | Image-receiving of Example No. 1 | 2 | 3 | 4 | 5 | 6 |
|---|---|---|---|---|---|---|
| $D_{RF}$ | 1.5 | 1.65 | 1.71 | 1.83 | 1.81 | 1.75 |
| $D_{TR}$ | 3.2 | 3.4 | 3.61 | 3.39 | 3.58 | 3.57 |
| Bronzing | (+) | (−) | (−) | (−) | (−) | |
| Dry in seconds | 180 | 100 | 100 | 40 | 70 | 70 |
| Yellowing ($D_{\gamma}$) | 0.21 | 0.15 | 0.13 | 0.11 | 0.12 | 0.13 |
| Image-forming speed in seconds | 15 | 15 | 13 | 10 | 12 | 13 |

I claim:

1. An image receivng material suited for use in the silver complex diffusion transfer reversal process which material contains a water-impermeable support coated with (1) an image-receiving layer containing physical development nuclei dispersed in a waterpermeable binder and (2) a waterpermeable top layer free from development nuclei and containing a hydrophilic colloid. characterized in that:

(i) the total solids coverage of said two layers (1) and (2) is at most 2 g/m2, (ii) in layer (1) the coverage of said nuclei is in the range of 0.1 mg/m2 to 10 mg/m2, and the coverage of binder is in the range of 0.4 to 1.3 g/m2, and (iii) in said top layer (2) the coverage of hydrophilic colloid is in the range of 0.1 to 0.9 g/m2.

2. An image receiving material according to claim 1, wherein the support is a transparent or opaque support that at the side of the image receiving layer is water-impermeable.

3. An image receiving material according to claim 2, wherein the support is a hydrophobic resin support or resin coated paper support.

4. An image receiving material according to claim 1, wherein the nuclei containing layer (1) is present on a nuclei-free underlying hydrophilic colloid undercoat layer or undercoat layer system having a coverage in the range of 0.1 to 1 g/m2 of hydrophilic colloid, the total coverage of layers (1) and (2) together with the undercoat being at most 2 g/m2.

5. An image receiving material according to claim 4, wherein the image-receiving layer is applied on an undercoat playing the role of a timing layer in association with an acidic layer serving for the neutralization of alkali of the image-receiving layer.

6. An image receiving material according to claim 1, wherein in the image-receiving layer (1) and/or in said top layer (2) and/or in an undercoat gelatin is present as hydrophilic colloid.

7. An image receiving material according to claim 6, wherein in the image-receiving layer (1) gelatin is present for at least 60 % by weight.

8. An image receiving material according to claim 6, wherein the gelatin is used in conjunction with an other hydrophilic colloid selected from the group consisting of polyvinyl alcohol, carboxymethyl cellulose, dextran, gallactomannans, alginic acid sodium salt and a water-soluble polyacrylamide.

9. An image receiving material according to claim 1, wherein the image-receiving material contains an optical brightening agent in the support, image-receiving layer and/or in an undercoat between the support and the image-receiving layer.

10. An image receiving material according to claim 9, wherein the optical brightening agent is inherently by its structure resistant to diffusion or is made resistant to diffusion by use in conjunction with another substance wherein it is dissolved or whereto it is adsorbed.

* * * * *